US009781786B2

(12) United States Patent
Ho et al.

(10) Patent No.: US 9,781,786 B2
(45) Date of Patent: Oct. 3, 2017

(54) CONTROL CIRCUIT AND METHOD OF A LED DRIVER

(71) Applicant: Richtek Technology Corporation, Zhubei, Hsinchu County (TW)

(72) Inventors: Jyun-Che Ho, Xikou Township, Chiayi County (TW); Isaac Y. Chen, Jubei (TW); Yi-Wei Lee, Taipei (TW)

(73) Assignee: RICHTEK TECHNOLOGY CORP., Zhubei, Hsinchu County (TW)

( * ) Notice: Subject to any disclaimer, the term of this patent is extended or adjusted under 35 U.S.C. 154(b) by 0 days.

(21) Appl. No.: 15/008,289

(22) Filed: Jan. 27, 2016

(65) Prior Publication Data

US 2016/0219662 A1 Jul. 28, 2016

(30) Foreign Application Priority Data

Jan. 28, 2015 (TW) ..... 104102835 A

(51) Int. Cl.
*H05B 33/08* (2006.01)

(52) U.S. Cl.
CPC ..... *H05B 33/0815* (2013.01); *H05B 33/0848* (2013.01)

(58) Field of Classification Search
CPC combination set(s) only.
See application file for complete search history.

(56) References Cited

U.S. PATENT DOCUMENTS

| | | | |
|---|---|---|---|
| 2011/0140620 | A1 | 6/2011 | Lin et al. |
| 2012/0013265 | A1 | 1/2012 | Yang et al. |
| 2014/0252972 | A1 | 9/2014 | Cao et al. |
| 2014/0361695 | A1 | 12/2014 | Akiyama et al. |

FOREIGN PATENT DOCUMENTS

| | | | |
|---|---|---|---|
| CN | 203984733 | U | 12/2014 |
| TW | I420955 | B | 12/2013 |

*Primary Examiner* — Douglas W Owens
*Assistant Examiner* — Jianzi Chen
(74) *Attorney, Agent, or Firm* — Muncy, Geissler, Olds & Lowe, P.C.

(57) ABSTRACT

A control circuit of a LED driver utilizes a counter to acquire a cycle and a conduction time or a non-conduction time of an AC phase-cut voltage outputted by a TRIAC dimmer. A bleeding signal is determined according to the cycle and the conduction time or the non-conduction time and used for adjusting a bleeding current so as to avoid a flickering of the LED. The control circuit does not need extra pins for coupling a large capacitor, but the bleeding signal can be still acquired. Preferably, the present invention is suitable for an IC of low pin numbers.

20 Claims, 18 Drawing Sheets

CONTROL CIRCUIT AND METHOD OF A LED DRIVER

CROSS-REFERENCE TO RELATED APPLICATIONS

This application claims the priority benefit of Taiwan Application No. 104102835, filed Jan. 28, 2015, the contents of which in its entirety are herein incorporated by reference.

FIELD OF THE INVENTION

The present invention is related generally to a light emitting diode (LED) driver of a triode alternating current (TRIAC) dimming and, more particularly, to a control circuit and a method of the LED driver for decreasing the pin numbers.

BACKGROUND OF THE INVENTION

FIG. 1 shows a conventional TRIAC dimmer 10 including resistors R1 and R2, a capacitor C1, a bidirectional trigger diode (DIAC) 12, and a TRIAC switch 14. The resistor R1 adopts a variable resistor. The resistors R1 and R2 and the capacitor C1 are serially coupled between two terminals of an alternating current (AC) power 16. The TRIAC switch 14 has a first terminal 142 and a second terminal 144 coupled to the two terminals of the AC power 16, respectively. A third terminal 146 of the TRIAC switch 14 is coupled to the capacitor C1 via the DIAC 12. At the beginning, the TRIAC switch 14 is in an off state. Namely, the AC voltage Vac is not input to a load. Moreover, the resistors R1 and R2 generate a current according to the AC voltage Vac for charging the capacitor C1. When the voltage at the capacitor C1 reaches a breakover voltage of the DIAC 12, the DIAC 12 will be turned on, thereby turning on the TRIAC switch 14. When the TRIAC switch 14 is turned on, the AC voltage Vac is input to the load and the capacitor C1 starts discharging. The TRIAC switch 14 keeps on until the AC voltage becomes zero or until a holding current I1 that passes the TRIAC switch 14 is lower than a threshold. That is to say, the TRIAC dimmer 10 converts the AC voltage Vac into an AC phase-cut voltage Vtr with a conduction angle to the load, as shown by a waveform 20 of the AC voltage Vac and a waveform 22 of the AC phase-cut voltage Vtr in FIG. 2. The conduction angle of the AC phase-cut voltage Vtr can be controlled by controlling a resistance value of the resistor R1. Namely, a conduction time Tc and a non-conduction time Tnc of the AC phase-cut voltage Vtr can be controlled. When the resistance value of the resistor R1 increases, the conduction angle of the AC phase-cut voltage Vtr decreases. Namely, the conduction time Tc of the AC phase-cut voltage Vtr decreases. Oppositely, when the resistance value of the resistor R1 decreases, the conduction angle of the AC phase-cut voltage Vtr increases. Namely, the conduction time Tc of the AC phase-cut voltage Vtr increases.

FIG. 3 shows a LED driver 30 with the TRIAC dimmer 10. The TRIAC dimmer 10 receives the AC voltage Vac and outputs the AC phase-cut voltage Vtr with the adjustable conduction angle. A rectifier 32 rectifies the AC phase-cut voltage Vtr to generate a DC phase-cut voltage Vin. Resistors R3 and R4 divide the DC phase-cut voltage to generate a voltage Vd, thereby allowing an integrated circuit (IC) 34 to acquire information of the DC phase-cut voltage Vin. The IC 34 controls the switching of the transistor Q1, thereby controlling a current at the LED string 36, so that the illumination of the LED in the LED string 36 can be controlled. However, as shown by FIG. 1, during the conduction of the TRIAC switch 14 of the TRIAC dimmer 10, the holding current I1 will be generated. However, the holding current I1 easily causes an abnormal waveform of the DC phase-cut voltage Vin, thereby resulting in a flickering of the LED string 36. In order to avoid the flickering, a bleeding circuit (not shown) is generally utilized for generating a bleeding current to countervail the influence of the holding current I1 on the DC phase-cut voltage Vin. Moreover, the holding current I1 relates to a time proportion D that is determined by the conduction time Tc or the non-conduction time Tnc of the DC phase-cut voltage Vin and a cycle T. Accordingly, a bleeding signal that is related to the time proportion D is required for controlling the bleeding current. Wherein, the time proportion D equals Tc/T or Tnc/T. FIG. 4 shows a conventional method for acquiring the bleeding signal Vdut. In the IC 34, a voltage-to-time circuit 38 generates signals Sd and Sdn according to the voltage Vd that is related to the DC phase-cut voltage Vin. Wherein, the signal Sdn is an inversion signal of the signal Sd. Referring to FIG. 5, the voltage-to-time circuit 38 can be implemented by a comparator 42. The comparator 42 compares the voltage Vd with a preset reference voltage Vref so as to generate the signal Sd. The signal Sd and the voltage Vd as well as the DC phase-cut voltage Vin have the same cycle T. Selecting the proper reference voltage Vref allows a pulse width of the signal Sd to equal a conduction time Tc of the voltage Vd, as shown by a waveform 44 of the voltage Vd and a waveform 46 of the signal Sd in FIG. 5, and consequently the signal Sd contains the information of the time proportion D=Tc/T. Referring to FIG. 4 again, the switching of switches SW1 and SW2 controlled by the signals Sd and Sdn generates a voltage Vh which has the same time proportion D=Tc/T as that of the signal Sd. An RC filter 40 formed by a resistor Rrc and a capacitor Crc filters the voltage Vh to generate the bleeding signal Vdut. Wherein, the bleeding signal Vdut is an average value of the voltage Vh, so the bleeding signal Vdut contains the information of the time proportion D. Other circuits in the IC 34 control the bleeding current according to the bleeding signal Vdut, thereby preventing the LED string 36 from flickering.

However, a frequency of the AC voltage Vac varies between 40 Hz and 60 Hz. Namely, the capacitor Crc with a large capacitance value is required for generating a larger RC time constant. Accordingly, the conventional circuit needs to increase a pin to connect the external capacitor Crc. Obviously, the conventional method for acquiring the bleeding signal Vdut is not suitable for the IC with low pin numbers. Therefore, it is desired a circuit and a method without extra pins to acquire the bleeding signal Vdut.

SUMMARY OF THE INVENTION

An objective of the present invention is to provide a control circuit for a LED driver with a TRIAC dimming and a method thereof. The control circuit and the method thereof acquire a bleeding signal without an extra pin.

According to the present invention, a control circuit of a LED driver comprises: a voltage-to-time circuit and a time-to-voltage circuit. The voltage-to-time circuit acquires a conduction time and a non-conduction time of a DC phase-cut voltage. The DC phase-cut voltage is generated by a rectifier rectifying an AC phase-cut voltage from a TRIAC dimmer. The TRIAC dimmer controls a conduction angle of the AC phase-cut voltage. The time-to-voltage circuit includes a clock generator configured to operably provide a clock; a first counter coupled to the voltage-to-time circuit and the clock generator, configured to operably count the conduction time or the non-conduction time of the DC phase-cut voltage according to the clock so as to generate a first counting value; a second counter coupled to the voltage-to-time circuit and the clock generator, configured to operably count a cycle of the DC phase-cut voltage according to the clock so as to generate a second counting value for adjusting a frequency of the clock; and a digital to analog circuit coupled to the first counter, configured to operably convert the first counting value into a bleeding signal so as to adjust a bleeding current wherein the bleeding current prevents the LED from flickering caused by the DC phase-cut voltage being influenced by a holding current of the triode alternating current dimmer.

According to the present invention, a method for controlling the LED driver comprises the steps of: counting a conduction time or a non-conduction time of the DC phase-cut voltage according to a clock so as to generate a first counting value; counting a cycle of the DC phase-cut voltage according to the clock so as to generate a second counting value for adjusting a frequency of the clock; and converting the first counting value into an analog bleeding signal for adjusting a bleeding current, wherein the bleeding current prevents the LED from flickering caused by the DC phase-cut voltage being influenced by a holding current of the triode alternating current dimmer. The DC phase-cut voltage is generated by a rectifier rectifying an AC phase-cut voltage from a TRIAC dimmer. The TRIAC dimmer controls a conduction angle of the AC phase-cut voltage.

According to the present invention, a control circuit of a LED driver comprises a voltage-to-time circuit and a time-to-voltage circuit. The voltage-to-time circuit receives a DC phase-cut voltage and acquires a conduction time and a non-conduction time of the DC phase-cut voltage. The DC phase-cut voltage is generated by a rectifier rectifying an AC phase-cut voltage from a TRIAC dimmer. The TRIAC dimmer controls a conduction angle of the AC phase-cut voltage. The time-to-voltage circuit includes: a clock generator configured to operably provide a clock; a first counter coupled to the voltage-to-time circuit and the clock generator, configured to operably count the conduction time or the non-conduction time of the DC phase-cut voltage according to the clock so as to generate a first counting value; a second counter coupled to the voltage-to-time circuit and the clock generator, configured to operably count a cycle of the DC phase-cut voltage according to the clock so as to generate a second counting value; a first digital to analog circuit coupled to the first counter, configured to operably convert the first counting value into a first voltage; a second digital to analog circuit coupled to the second counter, configured to operably convert the second counting value into a second voltage; and a divider coupled to the first and the second digital to analog circuits, configured to operably divide the first voltage and the second voltage so as to generate a bleeding signal for adjusting a bleeding current, wherein the bleeding current prevents the LED from flickering caused by the DC phase-cut voltage being influenced by a holding current of the triode alternating current dimmer.

According to the present invention, a method for controlling the LED driver comprises the steps of: counting a conduction time or a non-conduction time of the DC phase-cut voltage according to a clock so as to generate a first counting value; counting a cycle of the DC phase-cut voltage according to the clock so as to generate a second counting value, converting the first counting value into an analog first voltage; converting the second counting value into an analog second voltage; and dividing the analog first voltage and the analog second voltage so as to generate a bleeding signal for adjusting a bleeding current, wherein the bleeding current preventing the LED from flickering caused by the DC phase-cut voltage being influenced by a holding current of the triode alternating current dimmer. The DC phase-cut voltage is generated by a rectifier rectifying an AC phase-cut voltage from a TRIAC dimmer. The TRIAC dimmer controls a conduction angle of the AC phase-cut voltage.

According to the present invention, a control circuit of the LED driver comprises a voltage-to-time circuit and a time-to-voltage circuit. The voltage-to-time circuit acquires a conduction time and a non-conduction time of a DC phase-cut voltage. The DC phase-cut voltage is generated by a rectifier rectifying an AC phase-cut voltage from a TRIAC dimmer. The TRIAC dimmer controls a conduction angle of the AC phase-cut voltage. The time-to-voltage circuit includes: a clock generator configured to operably providing a clock; a two-phase output counter coupled to the voltage-to-time circuit and the clock generator, configured to operably count the conduction time or the non-conduction time of the DC phase-cut voltage according to the clock so as to generate a first counting value and count a cycle of the DC phase-cut voltage according to the clock so as to generate a second counting value for adjusting a frequency of the clock; and a digital to analog circuit coupled to the first counter, configured to operably convert the first counting value into a bleeding signal for adjusting a bleeding current, wherein the bleeding current prevents the LED from flickering caused by the DC phase-cut voltage being influenced by a holding current of the triode alternating current dimmer. Wherein, the two-phase output counter stops counting the cycle of the DC phase-cut voltage during counting the conduction time or the non-conduction time of the DC phase-cut voltage and stops counting the conduction time or the non-conduction time of the DC phase-cut voltage during counting the cycle of the DC phase-cut voltage.

According to the present invention, a method for controlling the LED driver comprises the steps of: counting a conduction time or a non-conduction time of the DC phase-cut voltage according to a clock so as to generate a first counting value and counting a cycle of the DC phase-cut voltage according to the clock so as to generate a second counting value for adjusting a frequency of the clock, wherein the cycle of the DC phase-cut voltage stops counting during counting the conduction time or the non-conduction time of the DC phase-cut voltage and the conduction time or the non-conduction time of the DC phase-cut voltage stops counting during counting the cycle of the DC phase-cut voltage; and converting the first counting value into an analog bleeding signal for adjusting a bleeding current, wherein the bleeding current prevents the LED from flickering caused by the DC phase-cut voltage being influenced by a holding current of the triode alternating current dimmer. The DC phase-cut voltage is generated by a rectifier rectifying an AC phase-cut voltage from a TRIAC dimmer. The TRIAC dimmer controls a conduction angle of the AC phase-cut voltage.

The control circuit and the method of the present invention do not need the capacitor with a large capacitance value to acquire the bleeding signal. Thus, the present invention does not need to add an extra pin, and the present invention can be applied to the IC with low pin numbers.

BRIEF DESCRIPTION OF THE DRAWINGS

These and other objectives, features and advantages of the present invention will become apparent to those skilled in the art upon consideration of the following description of the preferred embodiments according to the present invention taken in conjunction with the accompanying drawings, in which.

DETAILED DESCRIPTION OF THE INVENTION

Figure 1:
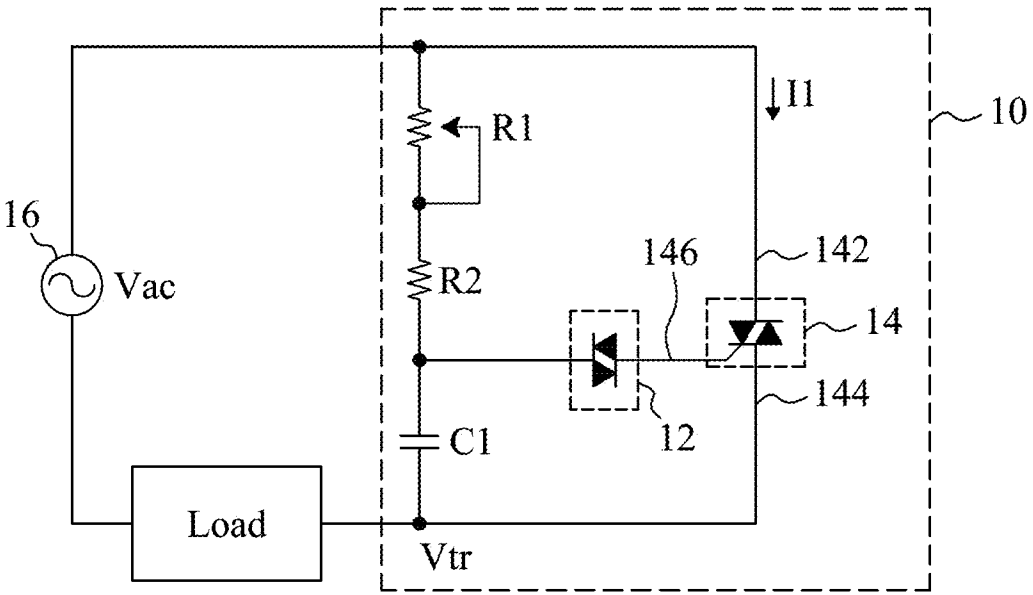
Fig. 1 Prior Art
FIG. 1 shows a conventional TRIAC dimmer.
Figure 2:
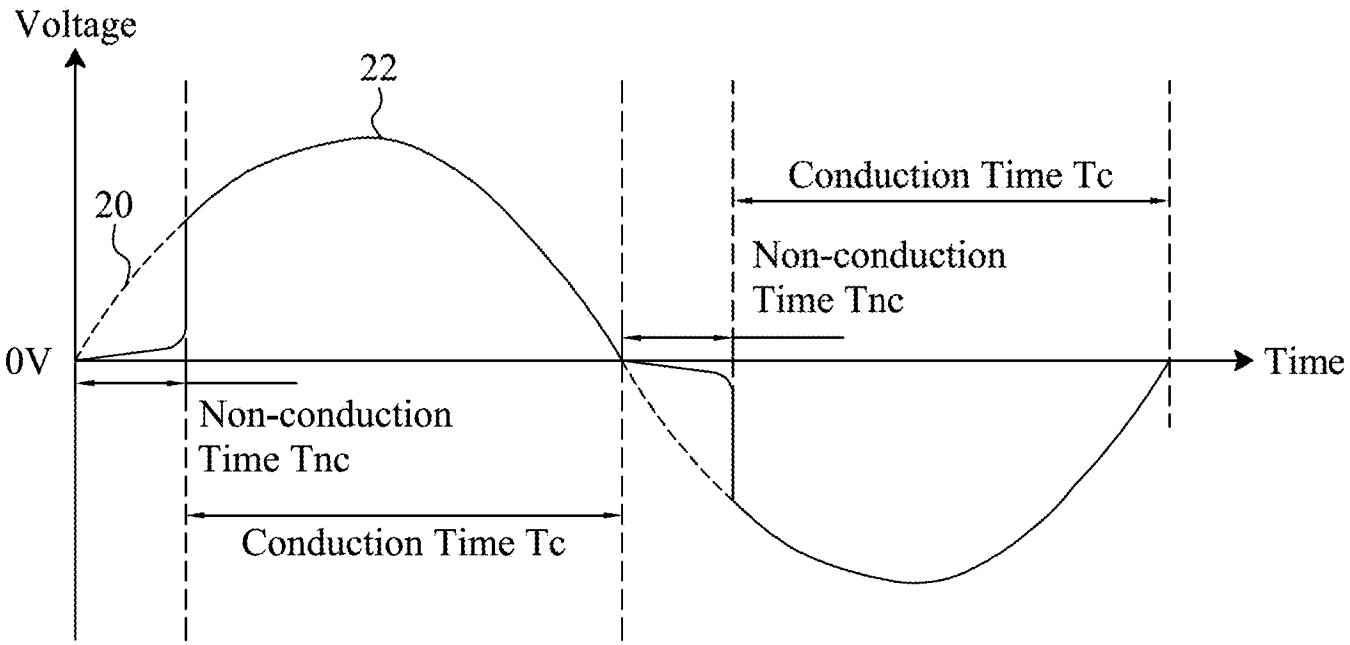
Fig. 2 Prior Art
FIG. 2 shows waveforms of an AC voltage Vac and an AC phase-cut voltage Vtr in FIG. 1.
Figure 3:
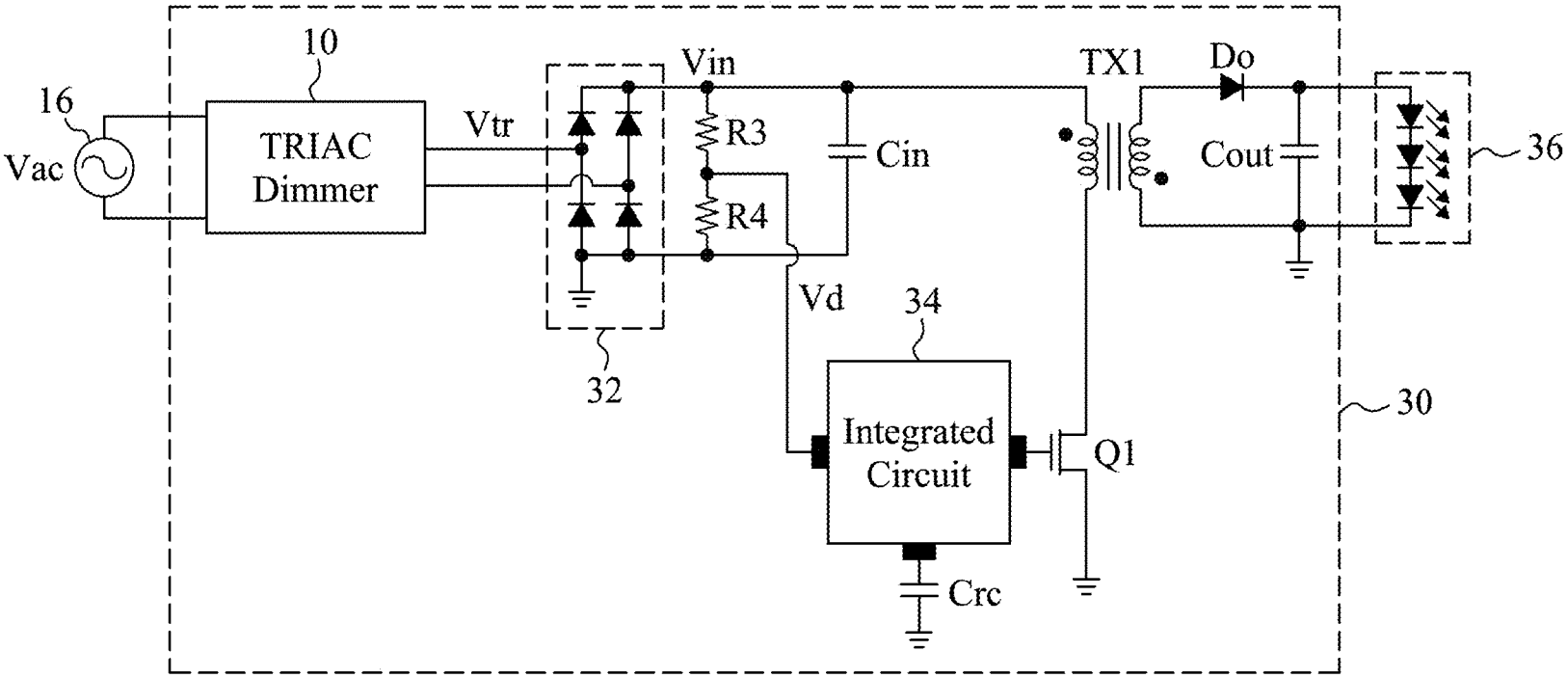
Fig. 3 Prior Art
FIG. 3 shows a LED driver with the TRIAC dimmer.
Figure 4:
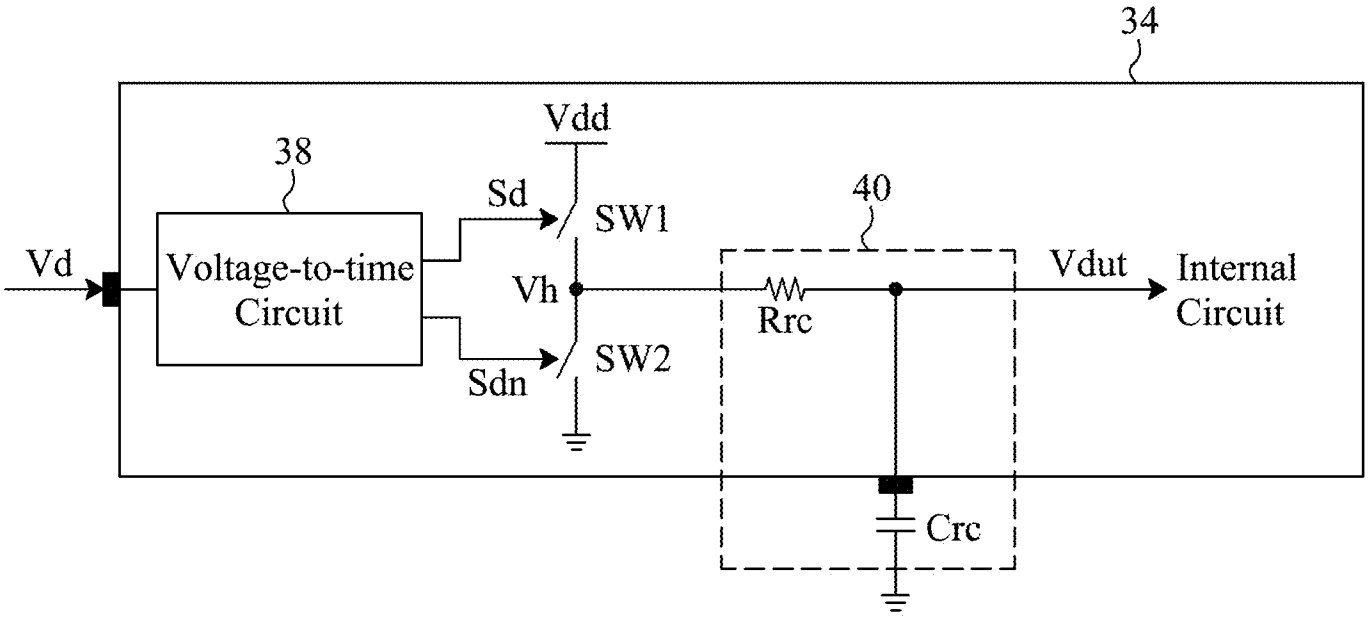
Fig. 4 Prior Art
FIG. 4 shows a conventional circuit that detects time proportion.
Figure 5:
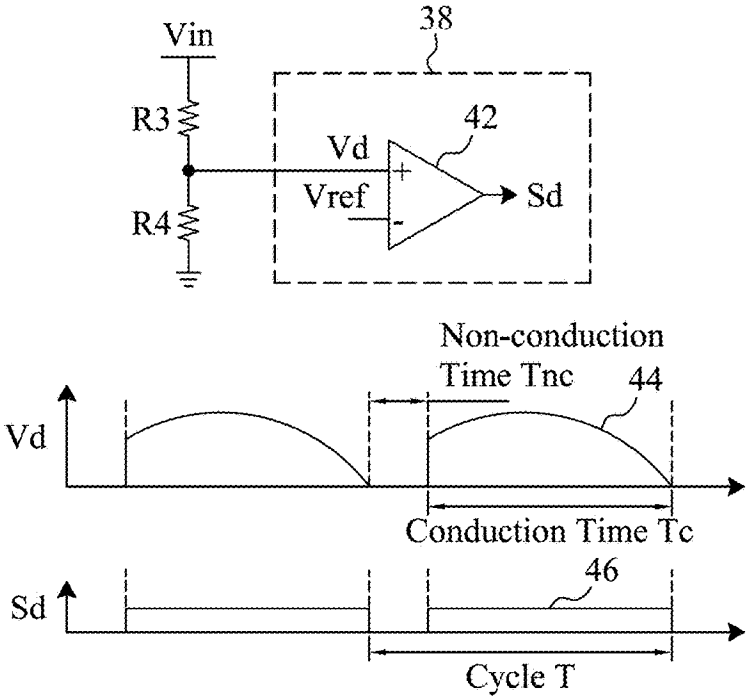
Fig. 5 Prior Art
FIG. 5 shows a voltage-to-time circuit and waveforms of a signal thereof.
Figure 6:
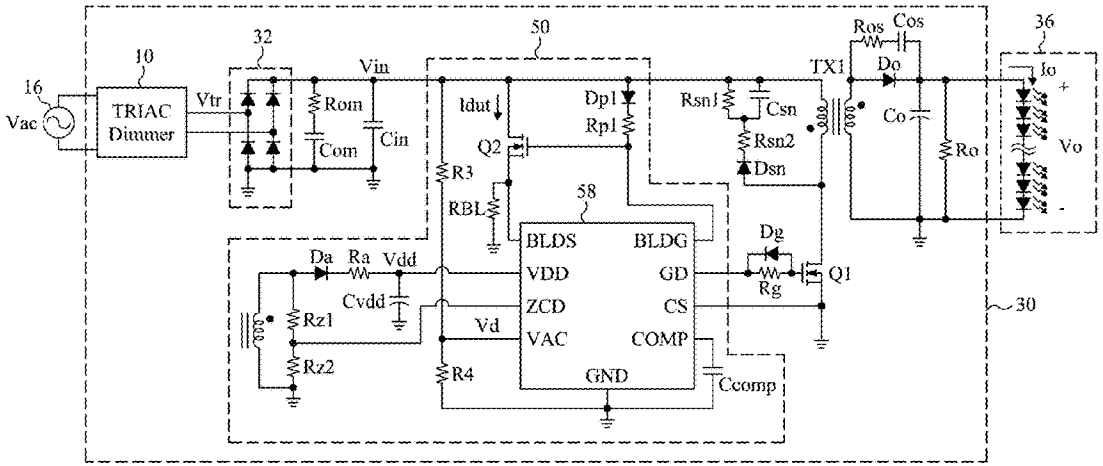
FIG. 6 shows a LED driver with the control circuit of the present invention.

FIG. 6 shows a LED driver 30 with a control circuit 50 of the present invention. The control circuit 50 controls the switching of a transistor Q1, thereby generating an output voltage Vo at a secondary side of a transformer TX1 so as to drive LED strings 36. Some parts of the circuits of the control circuit 50 in FIG. 6 are shown by the block diagram for a clearer illustration as in FIG. 7. In the control circuit 50 of FIG. 7, a voltage-to-time circuit 38 generates a signal Sd that has the same conduction time Tc, non-conduction time Tnc, and cycle T as those of a DC phase-cut voltage Vin via detecting a voltage Vd. The voltage-to-time circuit 38 can be implemented by a comparator 42, as shown in FIG. 5. The control circuit 50 in FIG. 7 includes a time-to-voltage circuit 52 for detecting the signal Sd so as to generate a bleeding signal Vdut for adjusting a bleeding current Idut that passes through a transistor Q2.

Figure 8:
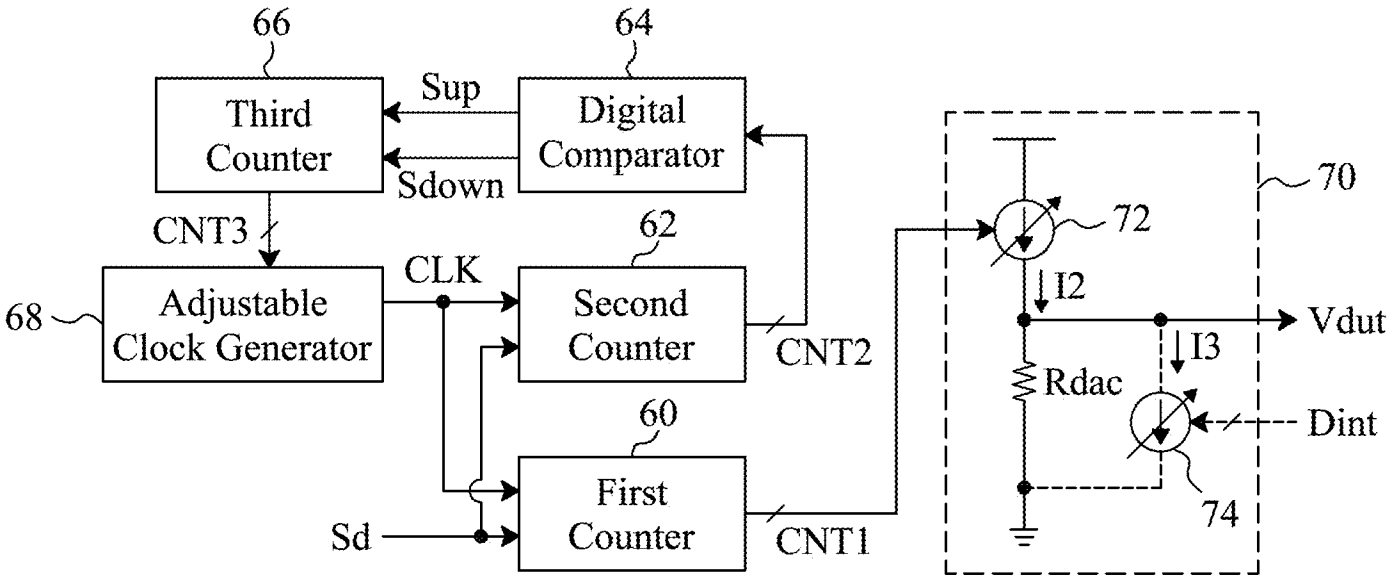
FIG. 8 shows a first embodiment of a time-to-voltage circuit in FIG. 7.
Figure 9:
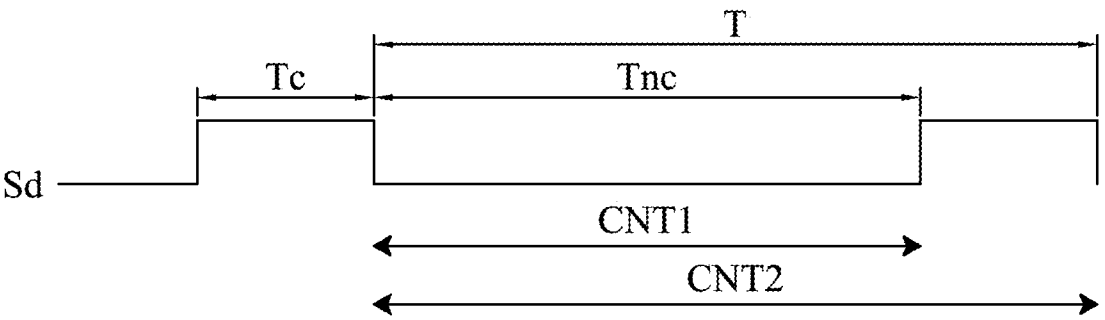
FIG. 9 shows a waveform of a signal Sd in FIG. 7.
Figure 10:
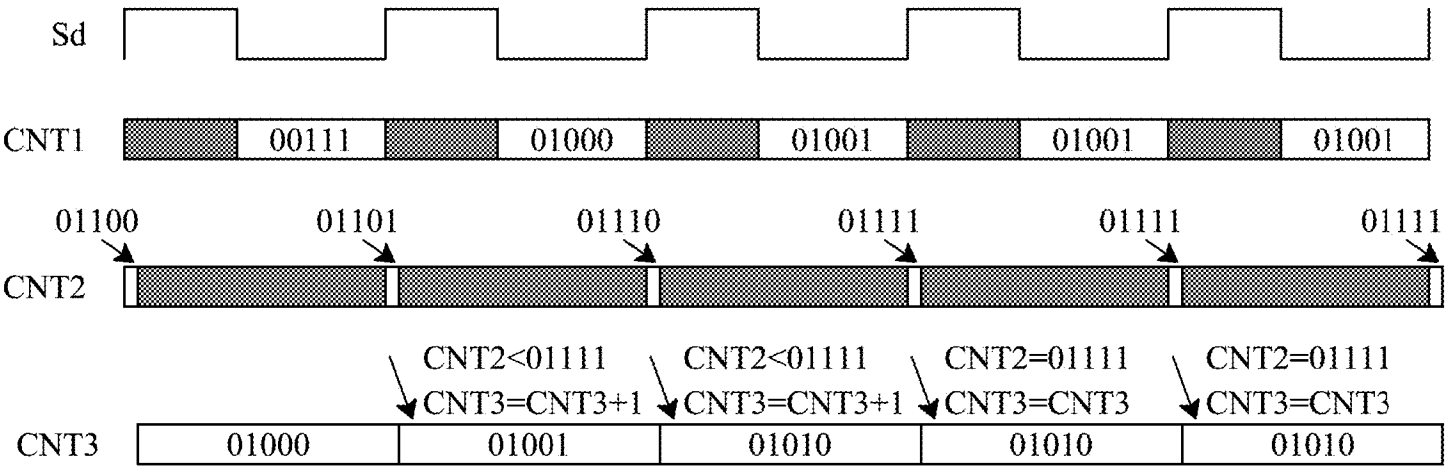
FIG. 10 shows an operation of the circuit in FIG. 8.

FIG. 8 shows a first embodiment of the time-to-voltage circuit 52, which includes a first counter 60, a second counter 62, a digital comparator 64, a third counter 66, a adjustable clock generator 68, and a digital to analog circuit (DAC) 70. The first counter 60, the second counter 62, and the third counter 66 can adopt the up-down counters. Referring to FIGS. 8 and 9, the first counter 60 counts the non conduction time Tnc of the signal Sd according to a clock CLK of the clock generator 68 so as to generate a first counting value CNT1. The digital to analog circuit 70 converts the first counting value CNT1 into the analog bleeding signal Vdut, whose level is related to the DC phase-cut voltage Vin. The second counter 62 counts the cycle T of the signal Sd according to the clock CLK so as to generate a second counting value CNT2. The third counter 66 provides a third counting value CNT3 to the clock generator 68 to determine a frequency of the clock CLK. The digital comparator 64 compares the second counting value CNT2 with a preset value so as to generate a signal Sup or Sdown to the third counter 66 to adjust the third counting value CNT3. The preset value is related to a length of a bit of the first counter 60. Namely, the preset value is related to the length of the bit of the first counting value CNT1. As shown in FIG. 10, if the preset value is "01111" and the second counting value CNT2 is "01101", the digital comparator 64 will send the signal Sup and the third counting value CNT3 will rise from "01000" to "01001" since the second counting value CNT2 is lower than the preset value, thereby increasing the frequency of the clock CLK. Oppositely, when the second counting value CNT2 is higher than the preset value, the digital comparator 64 will send the signal Sdown, so that the third counting value CNT3 will decrease so as to lower the frequency of the clock CLK. When the second counting value CNT2 equals the preset value, the digital comparator 64 does not output the signal Sup or Sdown so as to keep the third counting value CNT3 and the frequency of the clock CLK the same. That is to say, when the cycle T changes in view of the changing of the frequency of the AC voltage Vac, the time-to-voltage circuit 52 will adjust the frequency of the clock CLK, thereby stabilizing the second counting value at the preset value. Accordingly, the first counting value CNT 1 generated by the first counter 60 according to the signal Sd of the non-conduction time Tnc counted by the clock CLK will include an information of a time proportion D=Tnc/T. The bleeding signal Vdut can also include the information of the time proportion D=Tnc/T.

Figure 11:
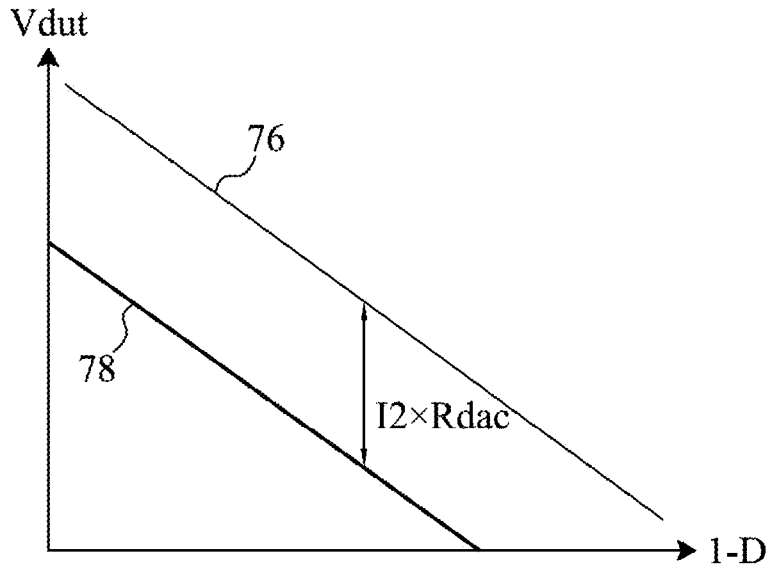
FIG. 11 shows relationship curves between a bleeding signal Vdut and a time proportion D.

In the digital to analog circuit 70 of FIG. 8, a current source 72 determines a current I2 to pass through a resistor Rdac according to the first counting value CNT1, thereby generating the bleeding signal Vdut. In this embodiment, the bleeding signal Vdut and the time proportion D=Tnc/T are in an inverse proportion as shown by a relationship curve 76 as shown in FIG. 11. That is to say, when the first counting value CNT1 increases, the time proportion D=Tnc/T rises and the current I2 increases to increase the bleeding signal Vdut. Accordingly, the bleeding current Idut will be increased. Oppositely, when the first counting value CNT1 decreases, the time proportion D=Tnc/T falls and the current I2 decreases to decrease the bleeding signal Vdut. Accordingly, the bleeding current Idut will be decreased. In other applications, the current source 74 can be added and coupled to the resistor Rdac in a parallel connection. Wherein, the current source 74 determines a current I3 according to a preset digital value Dint for dividing the current that passes through the resistor Rdac. Accordingly, the level of the bleeding signal Vdut will be shifted to acquire a relationship curve 78 in FIG. 11.

In afore embodiments, the first counter 60 counts the non-conduction time Tnc of the signal Sd. However, in other embodiments, the first counter 60 can also counts the conduction time Tc of the signal Sd so as to acquire the time proportion D=Tc/T. At this time, the bleeding signal Vdut and the time proportion D=Tc/T are in a direct proportion.

When the first counting value CNT1 increases, the time proportion D=Tc/T rises and the current I2 increases so as to increase the bleeding signal Vdut. Accordingly, the bleeding current Idut also increases. Oppositely, when the first counting value CNT1 decreases, the time proportion D=Tc/T falls and the current I2 decreases so as to decrease the bleeding signal Vdut. Accordingly, the bleeding current Idut decreases.

Figure 12:
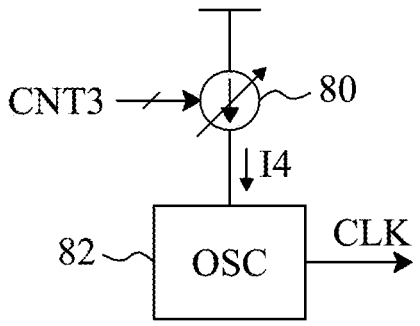
FIG. 12 shows an embodiment of a clock generator in FIG. 8.
Figure 13:
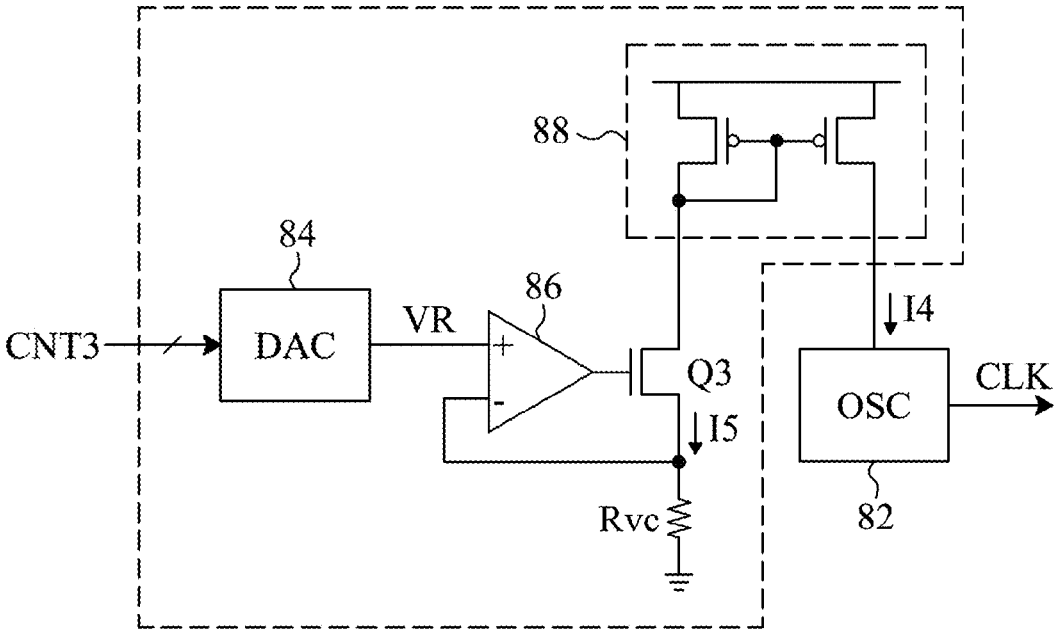
FIG. 13 shows an embodiment of a current source in FIG. 12.

FIG. 12 shows an embodiment of the clock generator 68 in FIG. 8. The clock generator 68 includes a current source 80 and an oscillator 82. The current source 80 determines a current I4 to the oscillator 82 according to the third counting value CNT3, and the oscillator 82 determines the frequency of the clock CLK according to the current I4. FIG. 13 shows an embodiment of the current source 80 in FIG. 12. The current source 80 includes a digital to analog circuit 84, an operation amplifier 86, a resistor Rvc, a transistor Q3, and a current mirror 88. The digital to analog circuit 84 determines a voltage VR according to the third counting value CNT3. The operation amplifier 86 delivers the voltage VR to the resistor Rvc so as to generate the current I5 to pass through the transistor Q3. The current mirror 88 mirrors the current I5 to generate the current I4 to the oscillator 82.

Figure 14:
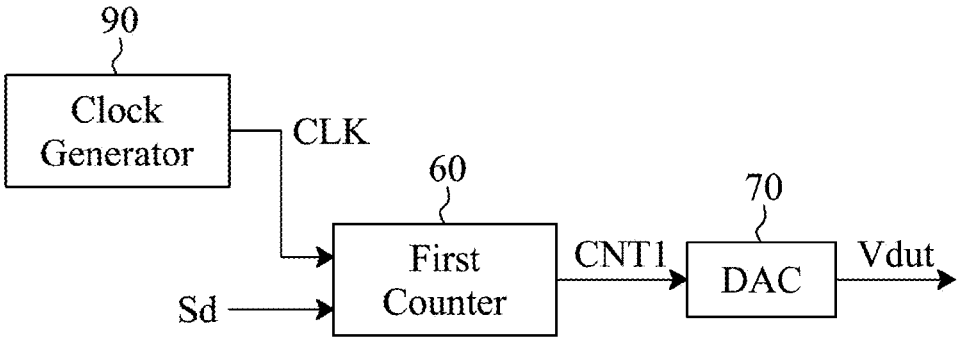
FIG. 14 shows a second embodiment of the time-to-voltage circuit in FIG. 7.

FIG. 14 shows a second embodiment of the time-to-voltage circuit 52, which includes a first counter 60, a digital to analog circuit 70, and a clock generator 90. The clock generator 90 provides a clock CLK with a fixed frequency. The first counter 60 counts the conduction time Tc or the non-conduction time Tnc of the signal Sd according to the clock CLK so as to generate a first counting value CNT1. The digital to analog circuit 70 converts the first counting value CNT1 into the analog bleeding signal Vdut so as to adjust the bleeding current of the TRIAC dimmer. The time-to-voltage circuit 52 in FIG. 14 merely applies to a case that has the AC voltage Vac with a fixed frequency.

Figure 15:
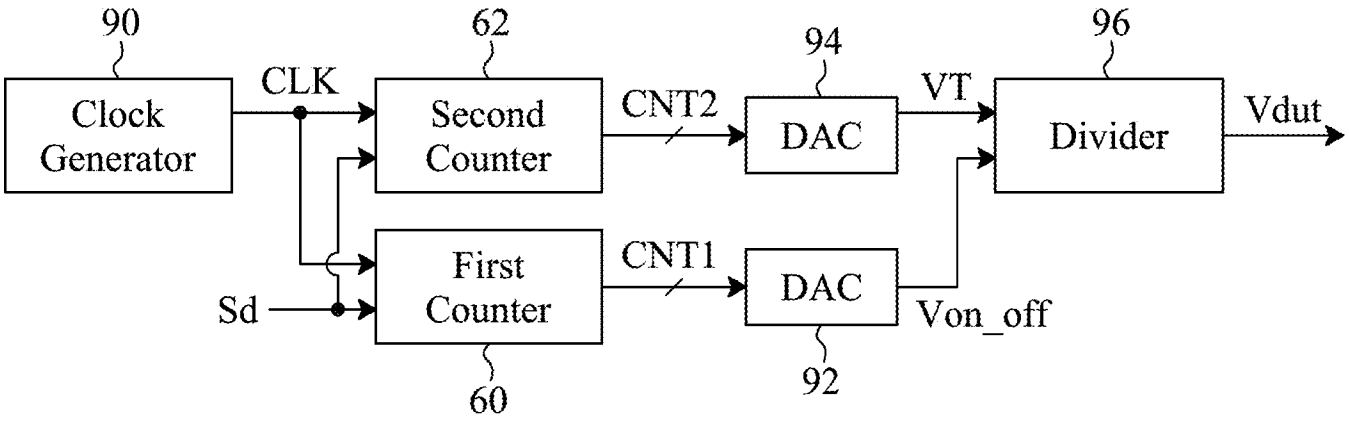
FIG. 15 shows a third embodiment of the time-to-voltage circuit in FIG. 7.

FIG. 15 shows a third embodiment of the time-to-voltage circuit 52, which includes a first counter 60, a second counter 62, a clock generator 90, two digital to analog circuits 92 and 94, and a divider 96. Referring to FIGS. 9 and 15, the clock generator 90 provides the clock CLK with a fixed frequency. The first counter 60 counts the conduction time Tc or the non-conduction time Tnc of the signal Sd according to the clock CLK so as to generate the first counting value CNT1. The second counter 62 counts the cycle T of the signal Sd according to the clock CLK so as to generate a second counting value. The two digital to analog circuit 92 and 94 convert the first counting value CNT1 and the second counting value CNT2 into the analog voltages Von_off and the voltage VT, respectively. The divider 96 divides the voltage VT and the voltage Von-Off so as to generate the bleeding signal Vdut for adjusting the bleeding current Idut.

Figure 16:
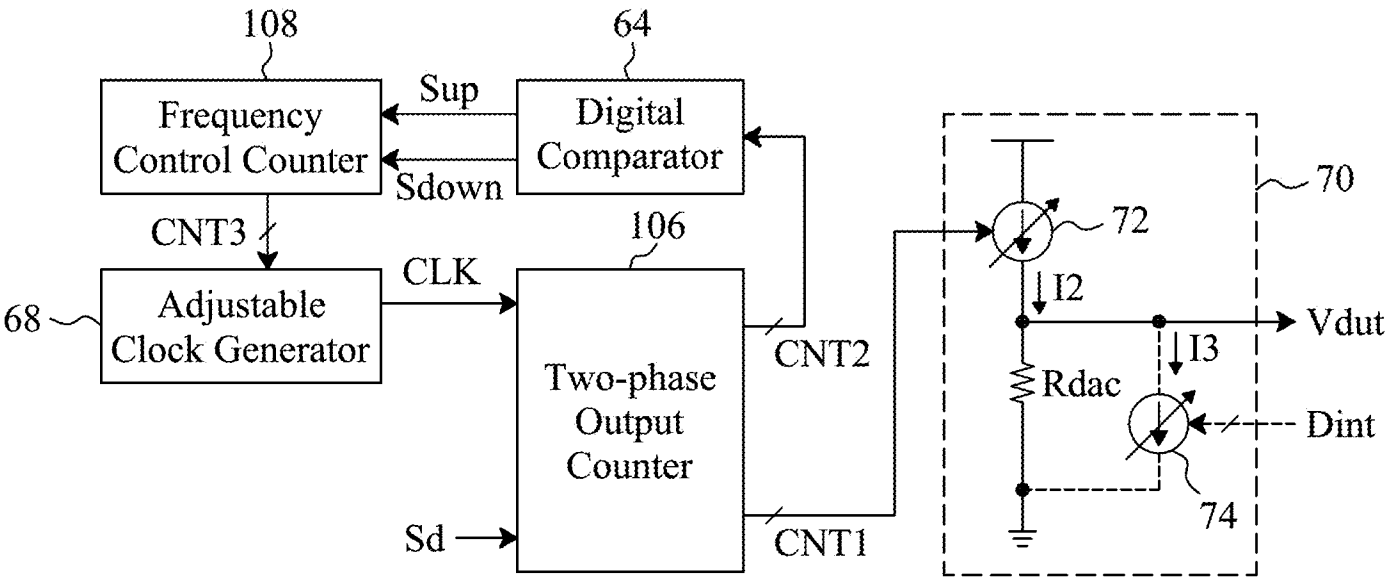
FIG. 16 shows a fourth embodiment of the time-to-voltage circuit in FIG. 7.
Figure 17:
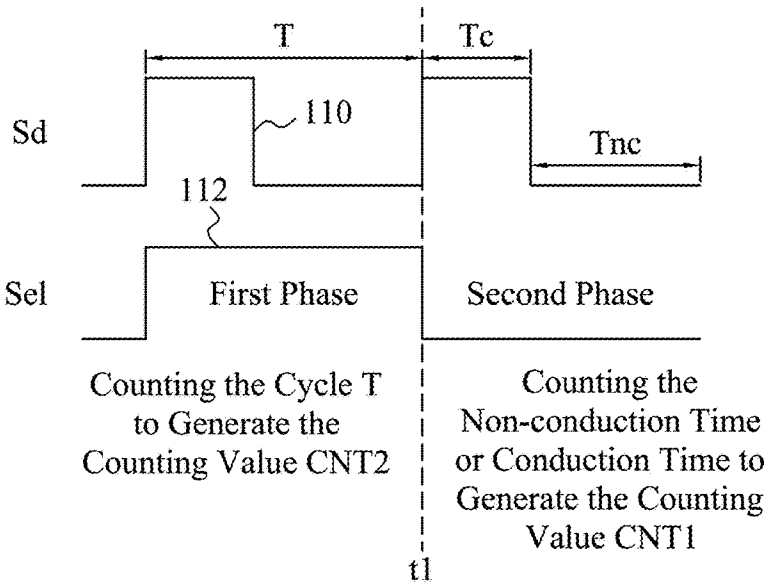
FIG. 17 shows an operation of a two-phase output counter in FIG. 16.

FIG. 16 shows a fourth embodiment of the time-to-voltage circuit 52, which includes a digital comparator 64, a clock generator 68, a digital to analog circuit 70, a two-phase output counter 106, and a frequency control counter 108. FIG. 17 shows the operation of the two-phase output counter 106 at two phases. Referring to FIGS. 16 and 17, during a first phase, the two-phase output counter 106 counts the cycle T of the signal Sd according to the clock CLK from the clock generator 68 so as to generate the second counting value CNT2. During a second phase, the two-phase output counter 106 counts the non-conduction time Tnc or the conduction time Tc of the signal Sd according to the clock CLK so as to generate the first counting value CNT1. Namely, the two-phase output counter 106 stops counting the cycle T of the DC phase-cut voltage Vin during counting the conduction time Tc or the non-conduction time of the DC phase-cut voltage and stops counting the conduction time Tc or the non-conduction time Tnc of the DC phase-cut voltage during counting the cycle T of the DC phase-cut voltage Vin. The digital to analog circuit 70 converts the first counting value CNT1 into the analog bleeding signal Vdut for adjusting the bleeding current Idut. The level of the bleeding signal Vdut is related to the DC phase-cut voltage Vin. The frequency control counter 108 provides a third counting value CNT 3 to the clock generator 68 so as to determine the frequency of the clock CLK. The digital comparator 64 compares the second counting value CNT 2 with a preset value so as to generate the signal Sup or Sdown to the frequency control counter 108, thereby adjusting the third counting value CNT3. The preset value is related to the length of the bit of the two-phase output counter 106. Namely, the preset value is related to the lengths of the bits of the first counting value CNT1 and the second counting value CNT2. When the second counting value CNT2 is lower than the preset value, the digital comparator 64 sends the signal Sup so as to increase the third counting value CNT3, thereby increasing the frequency of the clock CLK. Oppositely, when the second counting value CNT2 is higher than the preset value, the digital comparator 64 sends the signal Sdown so as to decrease the third counting value CNT3, thereby decreasing the frequency of the clock CLK. When the second counting value CNT2 equals the preset value, the digital comparator 64 does not output the signals Sup or Sdown, thereby keeping the third counting value CNT3 the same. Accordingly, the frequency of the clock CLK will be maintained the same.

Figure 18:
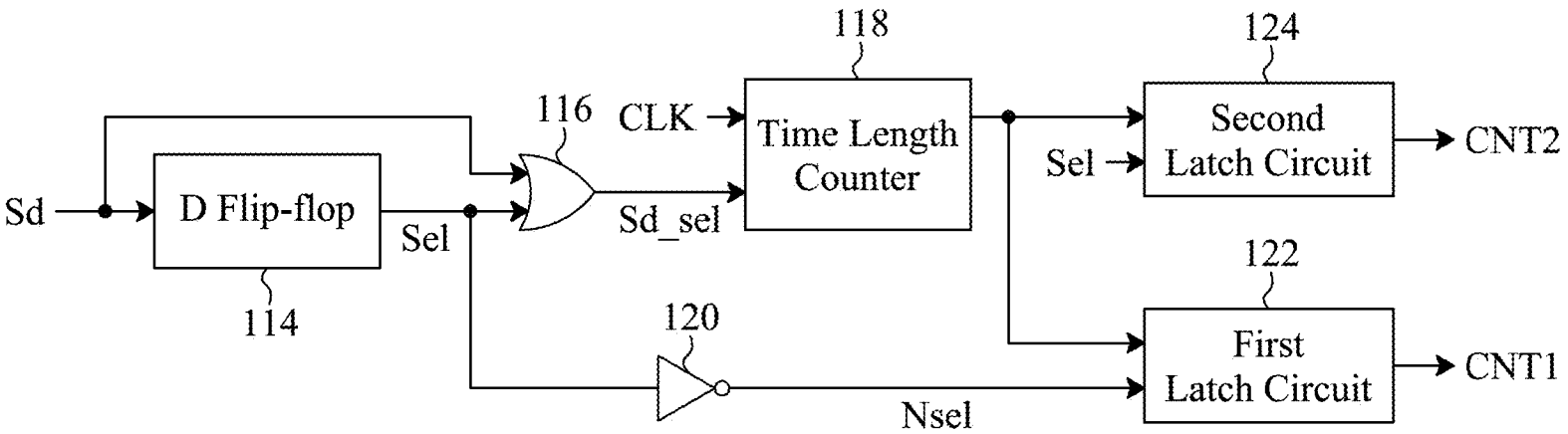
FIG. 18 shows an embodiment of the two-phase output counter in FIG. 16.

FIG. 18 shows an embodiment of the two-phase output counter 106, which includes a D flip-flop 114, an AND gate 116, a time length counter 118, an inverter 120, a first latch circuit 122, and a second latch circuit 124. The D flip-flop 114 generates a selecting signal Sel according to the signal Sd. As shown by waveforms 110 and 112 in FIG. 17, the selecting signal Sel includes a first phase and a second phase. The first phase and the second phase will be switched when the cycle T of the signal Sd is ending or starting, as shown by time t1 in FIG. 17. The signal Sd and the DC phase-cut voltage Vin have the same cycle T, so the first phase and the second phase will be switched when the cycle T of the DC phase-cut voltage is ending or starting. The AND gate 116 generates a signal Sd_sel according to the signal Sd and the selecting signal Sel. Referring to waveforms 110 and 112 in FIG. 17, the waveform of the signal Sd_sel outputted by the AND gate 116 is the same as that of the selecting signal Sel during the first phase of the selecting signal Sel. During the second phase of the selecting signal Sel, the waveform of the signal Sd_sel outputted by the AND gate 116 is the same as that of the signal Sd. The time length counter 118 receives the clock CLK and the signal Sd_sel. During the first phase of the selecting signal Sel, the time length counter 118 counts a pulse width of the signal Sd-sel according to the clock CLK. At this time, the pulse width of the signal Sd_sel equals the cycle T of the DC phase-cut voltage Vin. Accordingly, the time length counter 118 will generate the second counting value CNT2 that represents the cycle T, and at the same time, the selecting signal Sel triggers the second latch circuit 124 for saving the second counting value CNT2. During the second phase of the selecting signal Sel, the time length counter 118 counts the pulse width of the signal Se_sel according to the clock CLK. At this time, the pulse width of the signal Sd_sel equals the conduction time Tc of the DC phase-cut voltage Vin. Accordingly, the time length counter 118 generates the first counting value CNT1 that represents the conduction time Tc. At the same time, the inverter 120 generates an inversing signal Nsel according to the selecting signal Sel so as to trigger the first latch circuit for saving the first counting value CNT1. In other embodiments, during the second phase of the selecting signal Sel, the time length counter 118 can generate the first counting value CNT1 by counting the non-conduction time Tnc of the DC phase-cut voltage Vin.

The time-to-voltage circuit 52 in FIGS. 8, 14, 15, and 16 does not need a large capacitor to acquire the bleeding signal Vdut with the time proportion D. Moreover, the time-to-voltage circuit 52 in FIGS. 8, 14, 15, and 16 can be integrated in the IC 58 in FIG. 6. Therefore, the present invention does not need to add the extra pin to connect the large capacitor, but the present invention can still preferably acquire the bleeding signal Vdut with the time proportion D.

Figure 7:
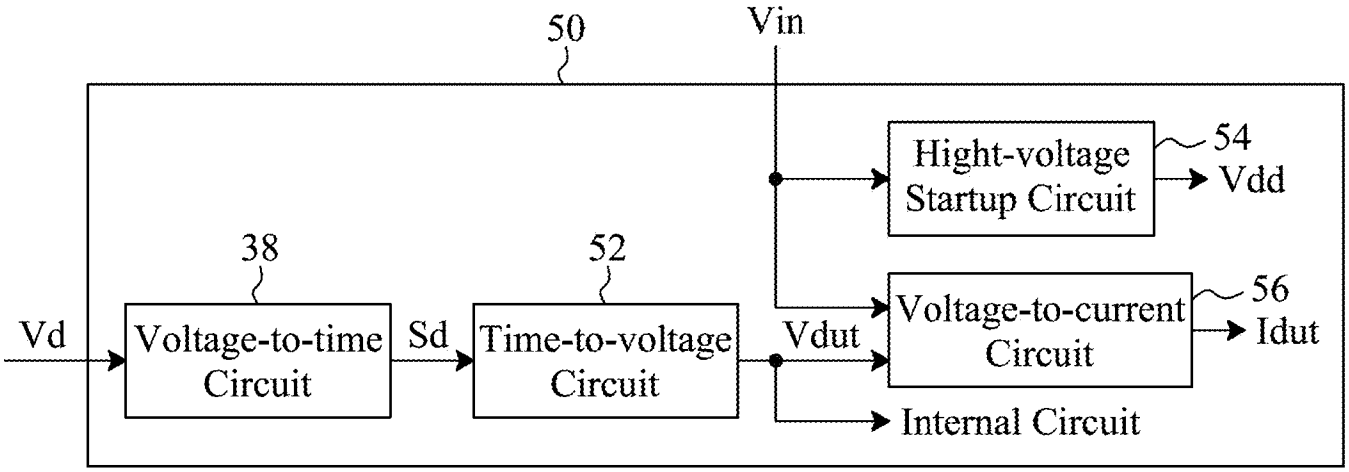
FIG. 7 shows a block diagram of the control circuit of the present invention.
Figure 19:
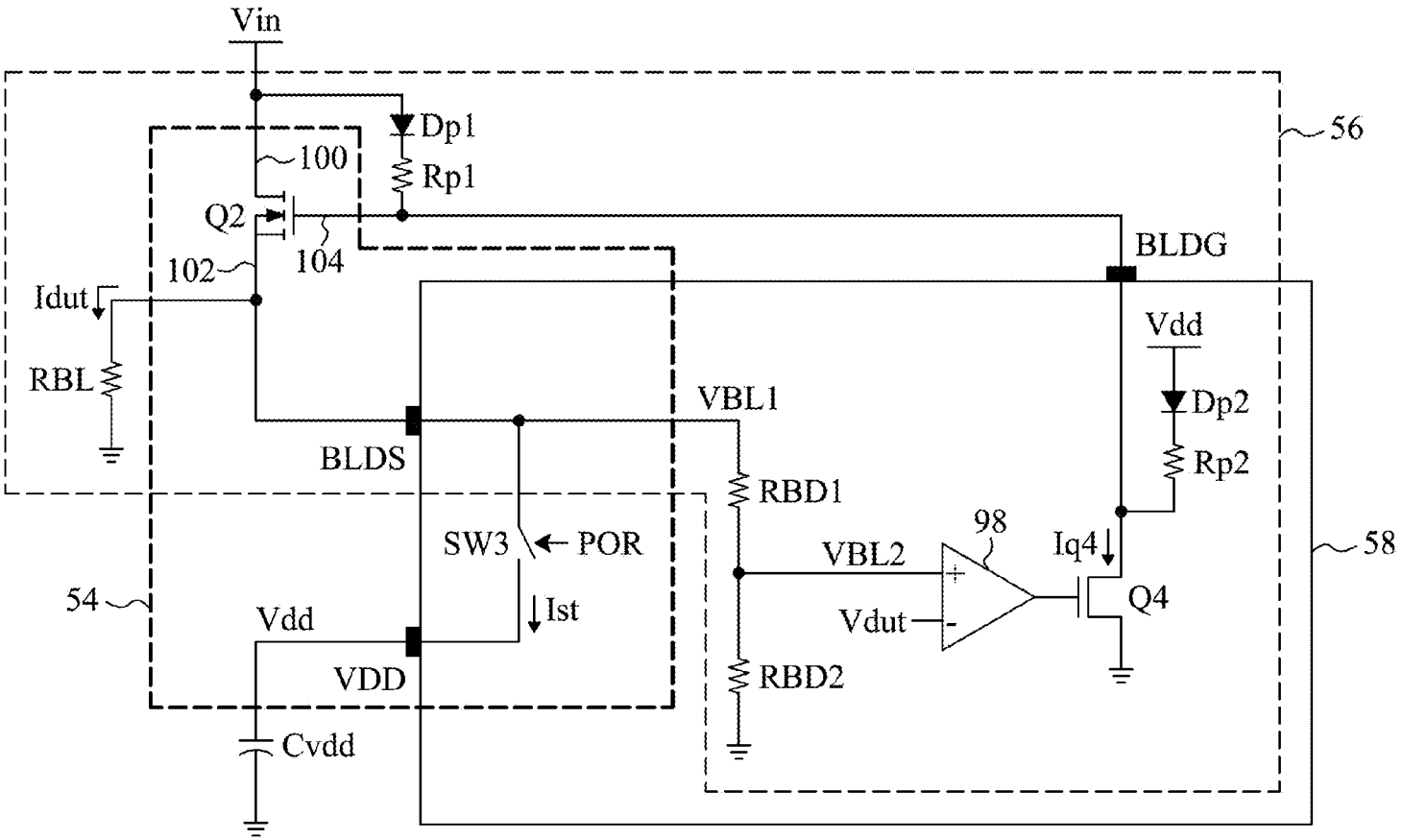
FIG. 19 shows an embodiment of a high-voltage startup circuit and a voltage-to-current circuit in FIG. 7.

A high-voltage startup circuit 54 in FIG. 7 is utilized for executing a soft start, thereby allowing a supply voltage Vdd to be increased to a preset value. A voltage-to-current circuit 56 in FIG. 7 adjusts the bleeding current Idut according to the bleeding signal Vdut for preventing the LED string 36 from flickering caused by the DC phase-cut voltage Vin being influenced by the holding current I1 of the TRIAC dimmer 10. FIG. 19 shows an embodiment of the high-voltage startup circuit 54 and the voltage-to-current circuit 56 in FIG. 7. The high-voltage startup circuit 54 includes a high-voltage transistor Q2 and a switch SW3. The high-voltage transistor Q2 includes an input terminal 100, an output terminal 102, and a control terminal 104. The input terminal 100 of the high-voltage transistor Q2 receives the DC phase-cut voltage Vin. The high-voltage transistor Q2 provides a soft start current Ist during the soft start and provides the bleeding current Idut during a normal operation. The switch SW3 is coupled between the output terminal 102 of the high-voltage transistor Q2 and a supply voltage capacitor Cvdd. Referring to FIGS. 6 and 19, the switch SW3 is turned on during the soft start, so that the high-voltage startup circuit 54 starts its operation. The high-voltage transistor Q2 provides the soft start current Ist to charging the supply voltage capacitor Cvdd via a pin BLDS, the switch SW3, and a pin VDD, so that the supply voltage Vdd rises. When the supply voltage Vdd rises and reaches a preset value, the soft start is ended. After that, the IC 58 starts controlling the switching of the transistor Q1 so as to light up the LED string 36. In order to avoid a current flowing from the capacitor Cvdd to the pin BLDS, the switch SW3 will be turned off when the soft start is ending, thereby turning off the high-voltage startup circuit 54. The voltage-to-current 56 includes the high-voltage transistor Q2, a bleeding resistor RBL, two resistors RBD1 and RBD2 that are serially connected, an operation amplifier 98, a transistor Q4, a diode Dp1, a resistor Rp1, a diode Dp2, and a resistor Rp2. Wherein, the bleeding resistor RBL and the two serially-connected resistors RBD1 and RBD2 are coupled to the output terminal 102 of the high-voltage transistor Q2. The operation amplifier 98 is coupled to the two serially-connected resistors RBD1 and RBD2 and receives the bleeding signal Vdut from the time-to-voltage circuit 52. The output terminal of the operation amplifier 98 is coupled to the control terminal of the transistor Q4. The diode Dp1 and the resistor Rp1 form a current path. The diode Dp2 and the resistor Rp2 form another current path. These two current paths provide a current Iq4. Referring to FIG. 19, after the soft start and during the normal operation, the voltage-to-current circuit 56 starts its operation. Wherein, the resistance values of the resistors RBD1 and RBD2 are much larger than that of the bleeding resistor RBL. Accordingly, the bleeding current Idut provided by the high-voltage transistor Q2 will flow through the bleeding resistor RBL so as to generate a voltage VBL1. The two serially-connected resistors RBD1 and RBD2 divide the voltage VBL1 to generate a voltage VBL2. The operation amplifier 98 controls the current Iq4 that is passing through the transistor Q4 according to a difference between the voltage VBL2 and the bleeding signal Vdut so as to control the voltage of the control terminal 104 of the high-voltage transistor Q2, thereby adjusting the bleeding current Idut. In the embodiment of FIG. 19, the voltage-to-current circuit 56 and the high-voltage startup circuit 54 utilize the same high-voltage transistor Q2 and the same pin BLDS, which preferably decreases the pin number and lowers the costs.

Figure 20:
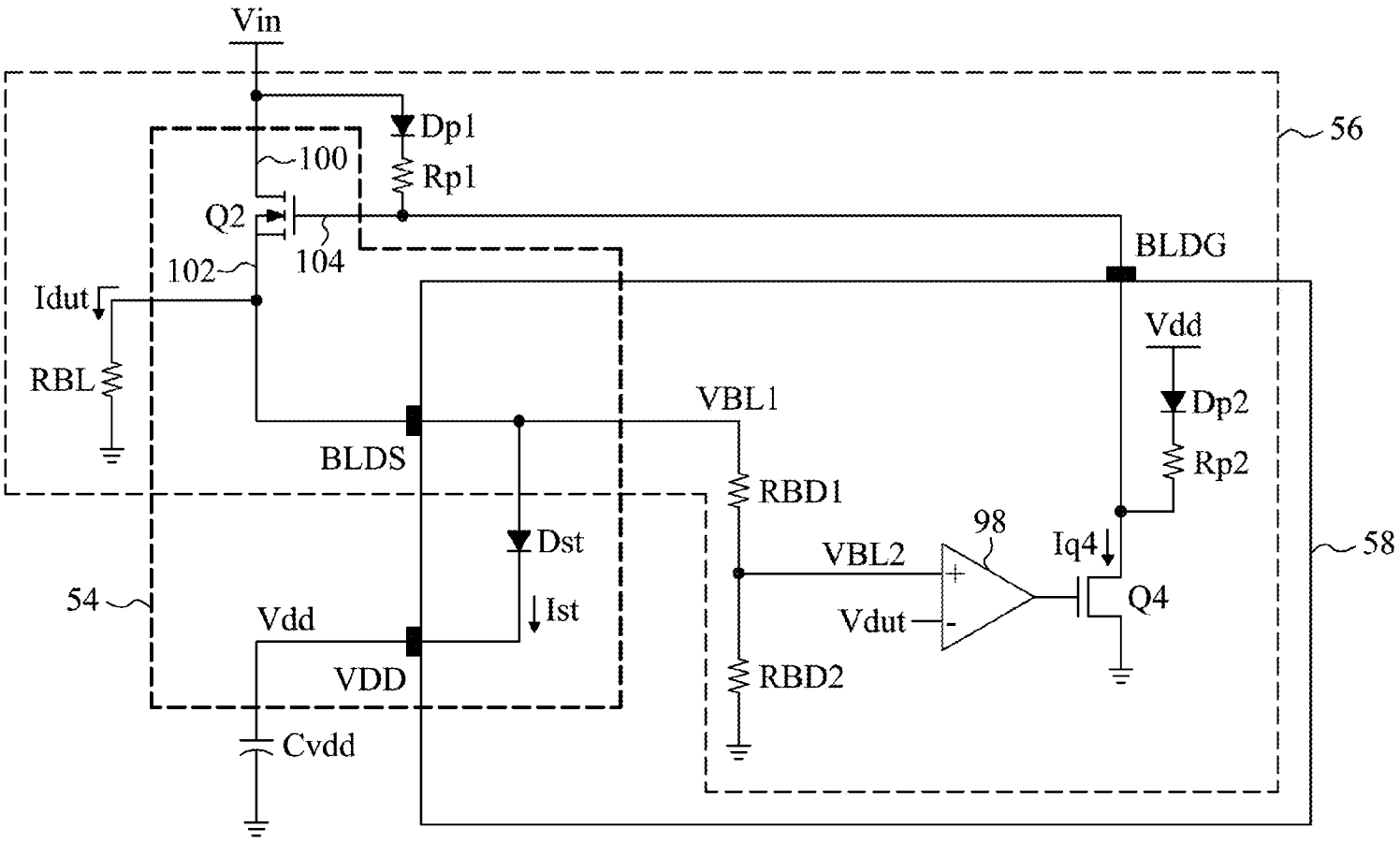
FIG. 20 shows another embodiment of the high-voltage startup circuit.

Referring to FIG. 20, the switch SW3 of the high-voltage startup circuit 54 can be replaced by a diode Dst. Wherein, an anode of the diode Dst is coupled to the output terminal of the high-voltage transistor Q2, and a cathode of the diode Dst is coupled to the supply voltage capacitor Cvdd. During the soft start, a difference between the voltage of the output terminal of the high-voltage transistor Q2 and the supply voltage Vdd is higher than a forward bias of the diode Dst. Accordingly, the diode Dst will be turned on so as to generate the soft start current Ist to charge the supply voltage capacitor Cvdd, thereby increasing the supply voltage Vdd. When the difference between the voltage of the output terminal of the high-voltage transistor Q2 and the supply voltage Vdd is lower than the forward bias of the diode, the soft start is ended and the diode Dst can prevent the current that is flowing from the capacitor Cvdd to the pin BLDS.

While the present invention has been described in conjunction with preferred embodiments thereof, it is evident that many alternatives, modifications and variations will be apparent to those skilled in the art. Accordingly, it is intended to embrace all such alternatives, modifications and variations that fall within the spirit and scope thereof as set forth in the appended claims.

What is claimed is:

1. A control circuit of an light emitting diode (LED) driver which is including a triode alternating current dimmer configured to operably receive an alternating current (AC) voltage and output an AC phase-cut voltage with an adjustable conduction angle, a rectifier configured to operably rectify the AC phase-cut voltage so as to generate a direct current (DC) phase-cut voltage, and a supply voltage capacitor configured to operably provide a supply voltage, the control circuit comprising:

a voltage-to-time circuit configured to operably acquire a conduction time and a non-conduction time of the DC phase-cut voltage; and a time-to-voltage circuit including:

a clock generator configured to operably provide a clock;

a counter circuit coupled to the voltage-to-time circuit and the clock generator, configured to operably count the conduction time or the non-conduction time of the DC phase-cut voltage according to the clock so as to generate a first counting value and count a cycle of the DC phase-cut voltage according to the clock so as to generate a second counting value for adjusting a frequency of the clock; and a digital to analog circuit coupled to the counter circuit, configured to operably convert the first counting value into a bleeding signal so as to adjust a bleeding current, wherein the bleeding current prevents the LED from flickering caused by the DC phase-cut voltage being influenced by a holding current of the triode alternating current dimmer.

2. The control circuit of claim 1, wherein a level of the bleeding signal is related to the DC phase-cut voltage.

3. The control circuit of claim 1, further comprising:

a high-voltage transistor including an input terminal which is configured to operably receive the DC phase-cut voltage, an output terminal, and a control terminal, configured to operably provide the bleeding current;

a bleeding resistor coupled to the output terminal of the high-voltage transistor, configured to operably generate a first voltage according to the bleeding current;

two resistors that are in a serial connection coupled to the output terminal of the high-voltage transistor, configured to operably divide the first voltage to generate a second voltage; and an operation amplifier coupled to the two resistors that are in a serial connection and the time-to-voltage circuit, configured to operably determine a voltage of the control terminal of the high-voltage transistor according to a difference between the second voltage and the bleeding signal so as to adjust the bleeding current.

4. The control circuit of claim 3, further comprising a switch coupled between the output terminal of the high-voltage transistor and the supply voltage capacitor, wherein the switch will be turned on during a soft start to raise the supply voltage.

5. The control circuit of claim 3, further comprising a diode whose anode is coupled to the output terminal of the high-voltage transistor and whose cathode is coupled to the supply voltage capacitor, wherein the diode will be turned on during a soft start to raise the supply voltage.

6. The control circuit of claim 1, wherein the counter circuit comprises:

a first counter coupled to the voltage-to-time circuit and the clock generator, configured to operably count the conduction time or the non-conduction time of the DC phase-cut voltage according to the clock so as to generate the first counting value; and a second counter coupled to the voltage-to-time circuit and the clock generator, configured to operably count the cycle of the DC phase-cut voltage according to the clock so as to generate the second counting value for adjusting the frequency of the clock.

7. The control circuit of claim 6, wherein the frequency of the clock increases when the second counting value is lower than a preset value and decreases when the second counting value is higher than the preset value.

8. The control circuit of claim 7, wherein the preset value is related to a length of a bit of the first counter.

9. The control circuit of claim 6, wherein the time-to-voltage circuit comprises:

a digital comparator coupled to the second counter, configured to operably compare the second counting value and a preset value; and a third counter coupled to the digital comparator and the clock generator, configured to operably provide a third counting value to the clock generator so as to determine the frequency of the clock, wherein when the second counting value is lower than the preset value, the third counting value increases so as to increase the frequency of the clock, and when the second counting value is higher than the preset value, the third counting value decreases so as to decrease the frequency of the clock.

10. The control circuit of claim 9, wherein the preset value is related to a length of a bit of the first counter.

11. The control circuit of claim 6, wherein the first counter is an up-down counter.

12. A method for controlling an light emitting diode (LED) driver which is including a triode alternating current dimmer configured to operably receive an alternating current (AC) voltage and output an AC phase-cut voltage with an adjustable conduction angle, a rectifier configured to operably rectify the AC phase-cut voltage so as to generate a direct current (DC) phase-cut voltage, and a supply voltage capacitor configured to operably provide a supply voltage, the method comprising the steps of:

counting a conduction time or a non-conduction time of the DC phase-cut voltage according to a clock so as to generate a first counting value;

counting a cycle of the DC phase-cut voltage according to the clock so as to generate a second counting value for adjusting a frequency of the clock; and converting the first counting value into an analog bleeding signal for adjusting a bleeding current, wherein the bleeding current prevents the LED from flickering caused by the DC phase-cut voltage being influenced by a holding current of the triode alternating current dimmer.

13. The method for controlling the LED driver of claim 12, wherein a level of the bleeding signal is related to the DC phase-cut voltage.

14. The method for controlling the LED driver of claim 12, wherein the step of adjusting the frequency of the clock comprises the steps of:

increasing the frequency of the clock when the second counting value is lower than a preset value; and decreasing the frequency of the clock when the second counting value is higher than the preset value.

15. The method for controlling the LED driver of claim 14, further comprising determining the preset value according to a length of a bit of the first counting value.

16. The method for controlling the LED driver of claim 12, wherein the step of adjusting the frequency of the clock comprises the steps of:

providing a third counting value for determining the frequency of the clock;

comparing the second counting value with a preset value;

increasing the third counting value to increase the frequency of the clock when the second counting value is lower than the preset value; and decreasing the third counting value to decrease the frequency of the clock when the second counting value is higher than the preset value.

17. The method for controlling the LED driver of claim 16, further comprising determining the preset value according to a length of a bit of the first counting value.

18. The method for controlling the LED driver of claim 12, further comprising generating the first counting value by an up-down counter.

19. The method for controlling the LED driver of claim 12, further comprising the steps of:

providing the bleeding current by a high-voltage transistor to a bleeding resistor so as to generate a first voltage, wherein an input terminal of the high-voltage transistor receives the DC phase-cut voltage;

dividing the first voltage to generate a second voltage; and determining a voltage of a control terminal of the high-voltage transistor according to a difference between the second voltage and the bleeding signal for regulating the bleeding current.

20. The method for controlling the LED driver of claim 19, further comprising coupling an output terminal of the high-voltage transistor to the supply voltage capacitor during a soft start so as to raise the supply voltage.

* * * * *